United States Patent [19]

Guille

[11] Patent Number: 4,579,390

[45] Date of Patent: Apr. 1, 1986

[54] WHEELCHAIR SEAT CUSHION WITH OCCUPANT RETAINING MEANS

[76] Inventor: Harold H. Guille, c/o Richard L. Fulfer, P.O. Box 3050, Modesto, Calif. 95353

[21] Appl. No.: 724,303

[22] Filed: Apr. 17, 1985

[51] Int. Cl.[4] ..... A47C 31/00

[52] U.S. Cl. ..... 297/467; 160/404; 297/45; 297/457; 297/DIG. 4

[58] Field of Search ..... 297/467, 45, 457, 441, 297/DIG. 4; 160/386, 387, 398, 404

[56] References Cited

U.S. PATENT DOCUMENTS

| | | | |
|---|---|---|---|
| 2,652,883 | 9/1953 | Holtzendorf | 297/467 X |
| 3,142,334 | 7/1964 | Vanderminden | 160/404 |
| 3,671,984 | 6/1972 | Ambrose | 297/457 X |
| 3,695,706 | 10/1972 | Basher | 297/457 X |

*Primary Examiner*—James T. McCall
*Attorney, Agent, or Firm*—Harvey B. Jacobson

[57] ABSTRACT

A flexible panel assembly including front, rear and opposite side marginal portions is provided and the opposite side marginal portions include tubular hems in which stiff strap type mounting bars are received. The opposite side mounting portions overlie front-to-rear extending opposite side support members of a wheelchair and are secured thereto by fasteners secured downwardly through the panel assembly, including the mounting bars, and anchored in the aforementioned support members. The central forward portion of the panel assembly includes an upstanding cushion-type abutment post for reception in the crotch area of a person seated in the wheelchair and upon the panel assembly and the abutment post and panel assembly include exterior surfaces which may be readily cleaned.

5 Claims, 3 Drawing Figures

FIG. 1
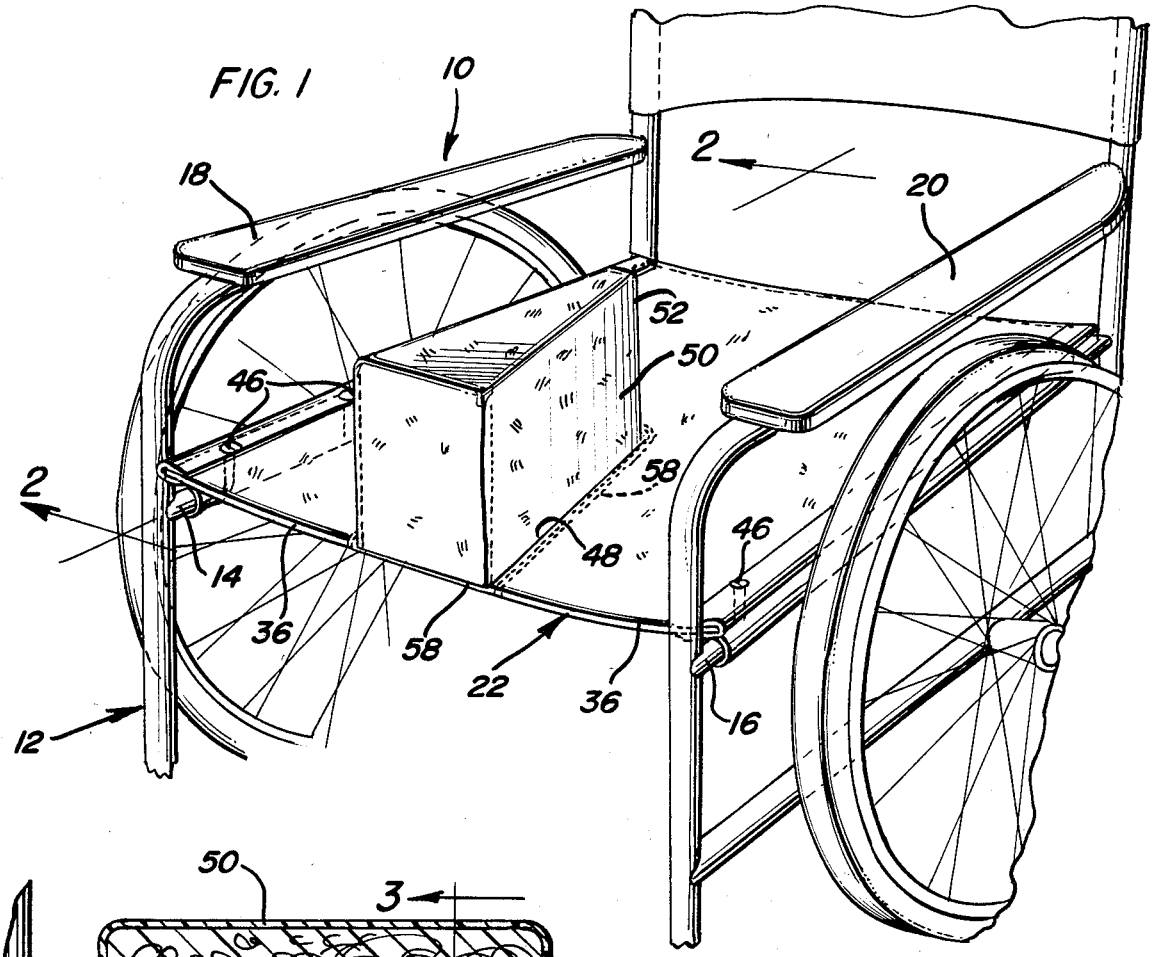
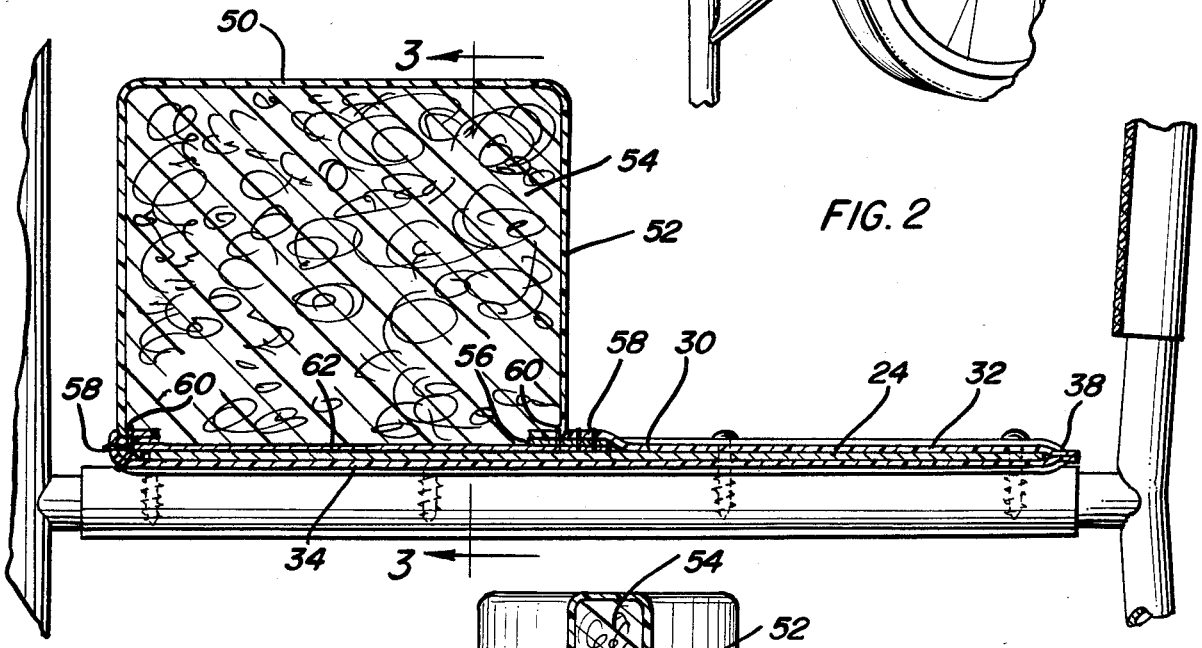
FIG. 2
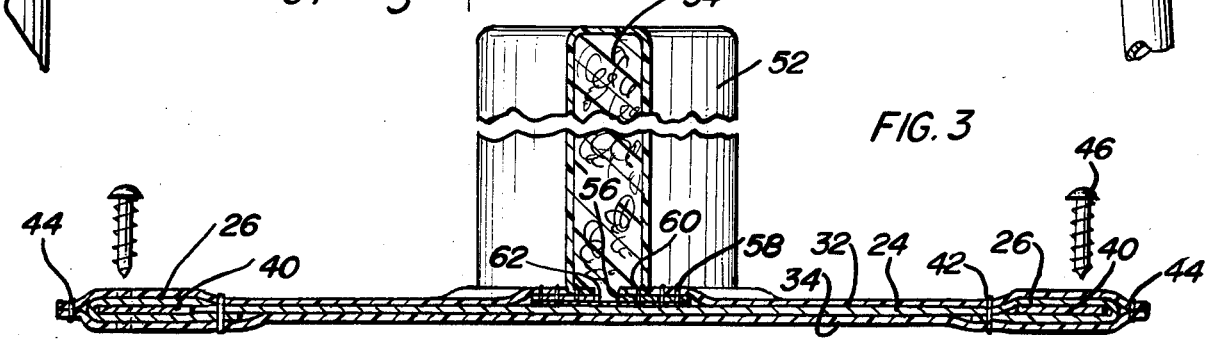
FIG. 3

WHEELCHAIR SEAT CUSHION WITH OCCUPANT RETAINING MEANS

BACKGROUND OF THE INVENTION

Some persons and patients who are temporarily or permanently confined to wheelchairs do not have the physical or mental capacity to retain themselves upright in a wheelchair. Accordingly, some of these persons must be strapped in wheelchairs in a manner not only preventing them from getting out of the wheelchairs but also in a manner to prevent them from sliding downwardly and forwardly in the wheelchairs and off the front portion of the wheelchair seats.

FIELD OF THE INVENTION

In order to prevent a person or patient disposed in a wheelchair from sliding downwardly and forwardly relative to the wheelchair seat this invention relates to the provision of a seat having a forward upstanding stationary cushion portion thereof to be received between the legs of the person in the wheelchair and immediately forward of the crotch area of that person. The cushion portion thereby defines an abutment engageable by the crotch area of a person disposed in the associated wheelchair to prevent that person from sliding forwardly on the wheelchair seat.

DESCRIPTION OF RELATED ART

Various different forms of wheelchair seats including upwardly projecting crotch area abutment structures heretofore have been provided such as those disclosed in U.S. Pat. Nos. 2,652,883, 2,949,152, 3,037,813 and 3,216,738. However, these previously known forms of wheelchair abutments do not include all of the adventageous structural and operational features of the occupant retaining seat cushion of the instant invention.

SUMMARY OF THE INVENTION

The wheelchair seat cushion of the instant invention includes a flexible seat cushion incorporating a flexible strong load supporting panel enclosed within a water impervious and abrasive resistant outer panel having stretch capabilities and from which an upwardly projecting cushion portion disposed at the forward central portion of the wheelchair seat cushion is mounted for abuting relation with the crotch area of a person seated on the seat cushion. The seat cushion is constructed in a manner whereby it may be readily removed and replaced and the flexibility of the cushion not only enhances the comfort of the person using the wheelchair but also enables the seat cushion to be used on a collapsible or foldable wheelchair.

The main object of this invention is to provide a wheelchair seat cushion with a forward central upstanding cushion portion for abuting engagement by the crotch area of a person seated in an associated wheelchair.

Another object of this invention is to provide a wheelchair cushion or seat which may be used in conjunction with foldable as well as non-foldable wheelchairs.

Still another important object of this invention is to provide a wheelchair seat cushion which may be readily cleaned.

A further object of this invention is to provide a wheelchair seat cushion which is substantially devoid of areas in which dirt and other external contamination may collect and avoid ready cleaning.

A final object of this invention to be specifically enumerated herein is to provide a wheelchair seat cushion in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a fragmentary perspective view of a wheelchair illustrating the seat cushion of the instant invention mounted thereon and the upstanding cushion portion thereof for opposing the crotch area of a person seated on the seat cushion;

FIG. 2 is an enlarged fragmentary vertical sectional view taken substantially upon the plane indicated by the section line 2—2 of FIG. 1; and FIG. 3 is a tranverse vertical sectional view taken substantially upon the plane indicated by the section line 3—3 of FIG. 2.

DESCRIPTION OF THE PREFERRED EMBODIMENT

Referring now more specifically to the drawing the numeral 10 generally designates a conventional form of wheelchair including a frame 12 incorporating a pair of opposite side front-to-rear extending seat support members 14 and 16. The frame 12 also includes opposite side front-to-rear extending arm rest portions 18 and 20 spaced above the seat support members 14 and 16, respectively.

The wheelchair 10 additionally includes a seat cushion assembly referred to in general by the reference numeral 22 mounted from and extending between the seat support members 14 and 16. The seat cushion assembly 22 includes a flexible main load supporting panel 24 equipped with opposite side front-to-rear extending tubular hems 26. The main panel 24 is loosely covered by an outer cover panel 30 including upper and lower portions 32 and 34 overlying and underlying, respectively, the main panel 24. The opposite ends of the forward marginal portions of the upper and lower portions 32 and 34 are integrally formed and joined by integral folded portions 36 which closely embrace the forward marginal edge of the support panel 24. The rear marginal edges of the portions 32 and 34 project rearward of the rear marginal edge of the support panel 24 and are joined together by stitching 38. A pair of stiff, strap-type mounting bars 40 are removably received in the hems 26 and the upper and lower portions 32 and 34 extend outwardly beyond the hems 36 and are secured by stitching 42 to the inner portion of the hems 26 and by stitching 44 outwardly of the remote portions of the hems 26. The bars 40 and the upper and lower portions 32 and 34 have registered openings formed therein through which mounting screws 46 are passed, the mounting screws 46 being threaded downwardly through appropriate openings (not shown) formed in the tubular seat support members 14 and 16.

The forward marginal edge of the upper portion 32 includes a central wedge shaped opening 48 formed therein and the base portion of an upstanding post or abutment cushion 50 is secured in the opening 48. The abutment cushion 50 includes a downwardly opening cover panel 52 and is filled with a resilient filling 54. An open frame panel 56 constructed of the same material of which the cover panel is constructed has its outer marginal edge portion secured beneath the underside of the marginal edges of the upper portion 32 disposed about opening 48 by stitching 58 and the lower marginal portion of the cover panel 52 is turned inwardly and secured to the inner marginal portion of the frame panel 56 by stitching 60. Also, a closure panel 62 is secured across the bottom of the abutment cushion 50 and to the marginal edges of the upper portion 32 defining the opening 48 by the stitching 58.

The juncture between the marginal edges of the upper portion 32 defining the opening 48 and the lower marginal portions of the cover panel 52 may be sealed by any suitable form of sealant. The cover panel 52 as well as the cover panel 30 preferably are constructed of naugahyde and the panel 24 is preferably constucted of heavy canvas or the like. In this manner, a flexible seat cushion is provided which may be readily cleaned and the abutment cushion 50 is received in the crotch area of a person seated in the wheelchair 10 to prevent that person from slipping forwardly and downwardly in the wheelchair 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a wheelchair frame including a pair of opposite side front-to-rear extending seat support members supported at their opposite end portions from the remainder of said frame, a flexible seat construction including an elongated horizontal strong flexible main panel member including sewn opposite end transverse tubular hems and opposite side longitudinal marginal portions between which said hems extend, one of said marginal portions comprising the front marginal portion and the other of said marginal portions comprising the rear marginal portion, an elongated flexible and durable cover panel including opposite side and opposite end edges and arranged transverse to said main panel member, of a length at least substantially twice the width of said main panel member and folded in half with the two halves thereof sandwiching said main panel member, from above and below, therebetween, the folded zone of said cover panel extending along and closely embracing said front marginal portion, each pair of relatively folded side edges being sewn together through the adjacent marginal portions of said hems and further sewn together adjacent the remote marginal portions of said hems, an elongated mounting strap member received in each of said hems, said hems, with said strap members disposed therein, being positioned over and extending along said seat support members, and elongated fasteners spaced along and secured downwardly through said hems and mounting strap members and anchored relative to said seat support members at points spaced longitudinally therealong.

2. The seat construction of claim 1 wherein said further sewing of said side edges together is disposed closely outward of said remote marginal portions of said hems.

3. The seat construction of claim 1 wherein the opposite end edges of said cover panel are sewn together rearward of the rear marginal portion of said main panel member.

4. The seat construction of claim 1 wherein the upper portion of said cover panel overlying said main panel includes an opening formed therein, a post comprising a downwardly opening pouch constructed of flexible cover material and filled with a resilient filling, the lower marginal portions of said pouch being downwardly received through said opening, an open frame of flexible reinforcing material disposed beneath and in registry with said opening, the outer marginal portion of said frame being sewn to the marginal edges of said upper portion of said cover panel defining said opening, the inner marginal portion of said frame projecting inwardly of said opening, the lower marginal portions of said pouch being turned inwardly and overlying the inner marginal portion of said frame and being sewn thereto.

5. In combination with a wheelchair including a pair of opposite side front-to-rear extending seat support members supported at their opposite ends from the remainder of said frame, a flexible seat construction including an elongated horizontal strong main flexible panel member including sewn opposite end transverse tubular hems and opposite side longitudinal marginal portions between which said hems extend, one of said marginal portions comprising the front marginal portion and the other of said marginal portions comprising the rear marginal portion, cover panel means at least substantially fully enclosing said main panel member with an upper portion of said cover panel means extending over said main panel member and a lower portion of said cover panel extending beneath said main panel member, the upper portion of said cover panel member including an opening formed therein closely adjacent said front marginal portion, a post comprising a downwardly opening pouch constructed of flexible cover material and filled with a resilient filling, the lower marginal portions of said pouch being downwardly received through said opening, an open frame of flexible material disposed beneath and in registry with said opening, an outer marginal portion of said frame underlying the marginal portions of said upper portion defining said opening and being sewn thereto, said frame including an inner marginal portion projecting inwardly of said opening, the lower portions of said pouch being turned inwardly and overlying said inner marginal portion of said frame and being sewn thereto, and elongated stiff mounting strap members received in said hems, said hems, with said strap members disposed therein, being disposed over and extending along said seat support members, and elongated fasteners spaced along and secured downwardly through said cover panel member and said hems and anchored relative to said seat support members, and a closure panel extending across and closing said opening from beneath the upper portion of said cover panel.

* * * * *